United States Patent [19]

Gidseg

[11] 4,340,991

[45] Jul. 27, 1982

[54] DEMOUNTABLE HINGE

[76] Inventor: Edward D. Gidseg, 22 Park Pl., Great Neck, N.Y. 11021

[21] Appl. No.: 58,294

[22] Filed: Jul. 17, 1979

[51] Int. Cl.[3] ..... E05D 1/06; E05D 7/10

[52] U.S. Cl. ..... 16/254; 16/321

[58] Field of Search ..... 16/149, 158, 181, 187

[56] References Cited

U.S. PATENT DOCUMENTS

| | | | |
|---|---|---|---|
| 1,002,373 | 9/1911 | De Lancey | 16/149 |
| 1,009,500 | 11/1911 | Glathart | 16/149 |
| 3,965,532 | 6/1976 | Wigfall | 16/149 |

*Primary Examiner*—Wayne L. Shedd

*Attorney, Agent, or Firm*—Pennie & Edmonds

[57] ABSTRACT

A demountable hinge is disclosed for mounting a door to a frame. The hinge is particularly suitable for cabinets such as kitchen cabinets and includes a first section, and a second section pivotally attached to the first section to provide rotative hinge action. The first section includes a generally rectangular tab portion which has a button-like projection upstanding from one side and is dimensioned to be received by a correspondingly configured receiver strap securable by screws to the frame. The receiver strap is constructed of resilient material and includes an aperture which is dimensioned and located to receive the button-like projection in resilient snapped engagement to retain the first section on the frame. The second section may either be adjustably fastened directly to the door by screws of the like, or it may be demountably attached to the door in a manner similar to that used to mount the first section to a frame. The various embodiments incorporate several different features for retaining the door and the associated hinge section in the "closed door" position, which features are relatively uncomplicated, inexpensive to manufacture, and aesthetically pleasing to the eye, a factor which is significant in hinges utilized for kitchen cabinets. The hinge of the present invention simplifies the assembly of kitchen cabinets and doors and makes it possible for suppliers to offer greater selections of different styles of cabinets and doors while permitting them to stock a greater number of cabinets and doors of differing styles and colors.

31 Claims, 11 Drawing Figures

FIG. 7
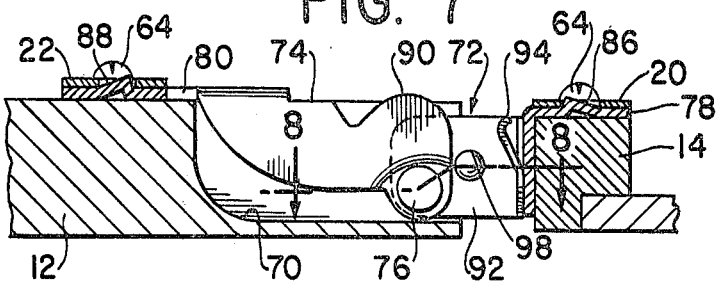
FIG. 8
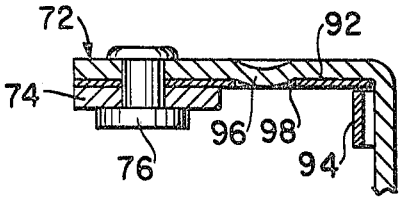
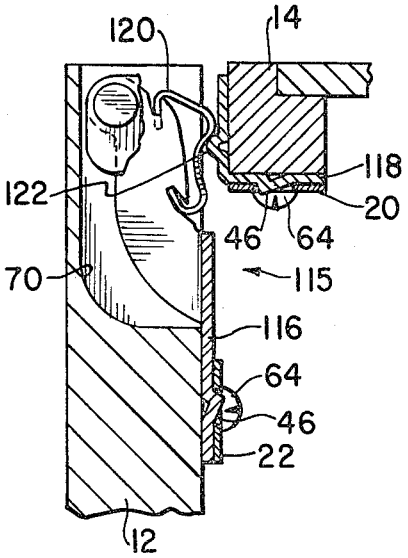
FIG. 12

FIG. 9
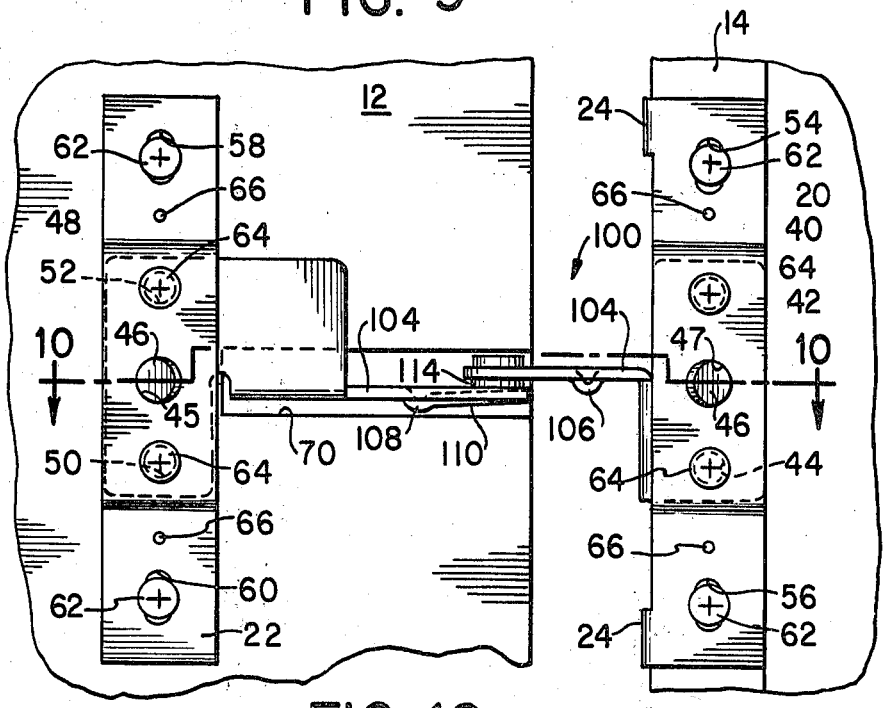
FIG. 10
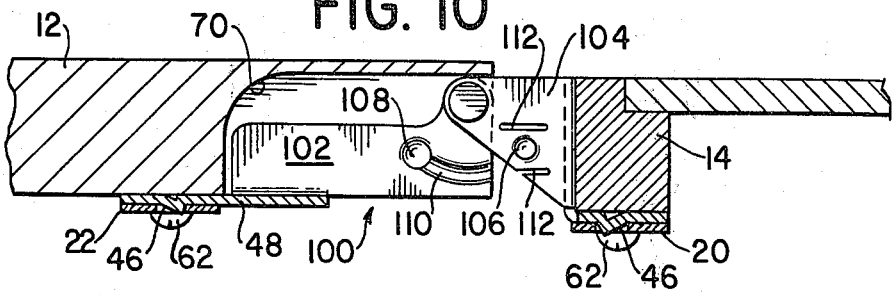
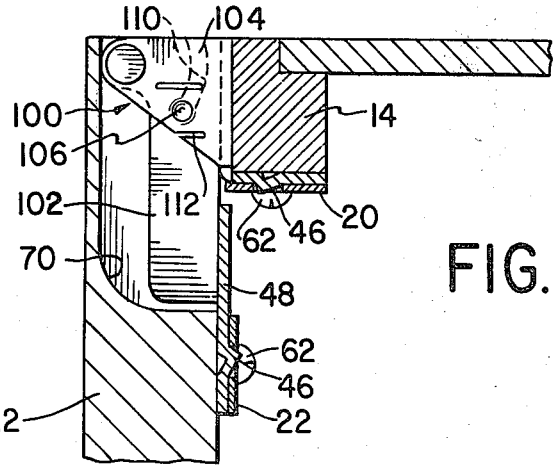
FIG. 11

DEMOUNTABLE HINGE

TECHNICAL FIELD

This invention relates to a demountable hinge for mounting a door to a frame. In particular, this invention relates to a demountable hinge for mounting cabinet doors which provides versatility and symmetry which is not available with present-day hinges.

BACKGROUND ART

Conventional hinges which are utilized to affix a door to a frame, are generally attached to the frame and to the doors with the use of standard fasteners such as screws or bolts or the like, and are usually dimensioned to be utilized with a specific type of frame and door. For example, a kitchen cabinet is generally comprised of a combination of one of several typesof cabinet frames—i.e. with or without a front stile—and one of several types of doors—i.e. either complete overlay or recessed from the end portions of the cabinet. The hinges which are used with such cabinetry are usually designed for a specific combination and purpose, thus minimizing the versatility which would otherwise be desirable not only from the standpoint of the end user, but also from the standpoint of the manufacturer, the wholesaler, the retailer, and the installer. For example, most present-day hinges which are constructed for left hand doors are generally not usable for mounting right hand doors and vise versa.

Variations in manufacturing styles and tolerances have long provided a significant deterrent with respect to the possible development of a hinge which would be readily and optionally mountable and demountable with respect to the cabinet frame or door (or both) with a minimum amount of major adjustment being required when a door is actually assembled with a cabinet. Manufacturers and suppliers of kitchen cabinetry have generally been required, out of necessity, to stock many types of cabinets and many types of doors either wholly or partially assembled so as to satisfy the particular needs and whims of their numerous potential customers. Such excesses in cabinet stocks are generally quite space consuming and expensive and the elimination of such requirements would be particularly desirable for a plurality of economic and practical reasons.

Attempts have been made to standardize hinge construction for the purpose of avoiding the problems heretofore described and to accommodate high-capacity cabinet constructions. For example, U.S. Pat. No. 3,423,786 to Arias, Jr., et al. is directed to a cabinet hinge having separable hinge leaves wherein first and second hinge leaves are hingedly connected through a connector portion of the second hinge leaf. The connector portion extends perpendicularly from the hinged connection and provides a free end which is spaced therefrom. A second hinge leaf mounting portion is formed with an opening and outwardly covering channel therein, complementary to the connector portion for endwise slidably receiving the connector portion free end therein, substantially outwardly covered thereby and with resiliently engageable detent means therebetween to retain the assembly.

While the hinge described in the '786 patent may reduce somewhat the problems heretofore described concerning the manufacture and marketing of kitchen cabinetry, this hinge does not eliminate a sufficient number of these problems significantly enough to substantially affect, in a positive manner, the manufacturing and marketing of kitchen cabinetry. In particular, it will be appreciated that the hinge of the '786 patent does not provide the dual multi-directional symmetry and consequent versatility which would make it possible to mount and demount any combination of a plurality of types of cabinet frames and doors in any number of desired arrangements. In particular, it should be noted that the '786 patent describes a "pin-type" hinge, the major portion of which is permanently mountable to the cabinet frame, while one leaf thereof is removably mountable to the door by means of a mounting portion 36.

In addition, it should be noted that with most hinges which are presently available to the consumer, including the hinge described in the '786 patent, the pivot position of the hinge is usually fixed by screws with respect to the door, thus limiting the combination of cabinets and doors which may be matched, notwithstanding the fact that the color or design of the door may be varied to some degree. Another inconvenience in present day hinges is provided by the fact that the dimension of the door can not be changed to achieve the necessary symmetrical effect of the door, both visually and functionally, in relation to the frame.

Also, since, particularly in the case of kitchen cabinets, it is desirable (and often necessary) that the door be biased toward, or at least be actually held in, a closed position, many manufacturers place a magnet and matching metal plate on the cabinet frame and door, respectively. Alternatively, some manufacturers utilize a bullet clip or other holding device to retain the door in the closed position. In other instances hinge manufacturers have utilized various types of expensive and bulky devices including springs, pistons etc. to hold the door of a cabinet in a closed position or to bias the door toward the closed position once it has been moved slightly in the appropriate direction. In essence the provision of such convenience has been inherently difficult and expensive, particularly in the manufacture of kitchen cabinets primarily because of the severe space and aesthetic limitations which are inherent in their design. I have invented a hinge which avoids the aforementioned disadvantages of the present day hinges.

SUMMARY

A hinge is disclosed for mounting a door or the like to a frame which comprises, a first section, a second section pivotally attached to the first section, means associated with the first section and dimensioned and configured to be selectively attached to and/or detached from the frame by engaged reception by receiver means mounted on the frame, and means to attach the second section to the door.

According to a preferred embodiment, my invention relates to a self-latching hinge for pivotally mounting a cabinet door to a cabinet frame which comprises a first hinge leaf section, a second hinge leaf section attached to the first hinge leaf section by a pivot pin for pivotal rotation relative thereto, receiver means in the form of a plate-like member of resilient material securable by fastener means such as screws and defining an aperture, a tab portion secured to, or forming part of the first section for selective removable reception by the receiver means so as to facilitate selective mounting and/or demounting of the first section with respect to the frame, the tab portion having a button-like member upstanding therefrom and being configured, positioned and dimensioned for resilient engaged reception by an aperture defined by the receiver means for retaining the tab portion and first section affixed to the frame. My inventive hinge also comprises a tab portion connected to or forming part of the second section, means to removably attach and/or detach the second section with respect to the door, and resilient means fixed with respect to the first section and positioned and dimensioned for progressive resilient engagement by the second section when the second section is pivotally rotated between positions corresponding to closed and opened door positions. The resilient means and the second section are configured and dimensioned to cooperatively engage with each other at least to bias and retain the second section and the door toward the closed door position.

My inventive hinge may optionally be utilized with or without receiver means to affix or fasten the hinge to the door. Since the same hinge may be used without such receiver means, in such case the hinge section is secured directly to the door by suitable screw-type fasteners. In addition, it should be noted that in the case of cabinets such as kitchen cabinets, the provision of receiver means for reception and retention of the hinge section in fixed relation at least with the frame, allows the cabinet to be manufactured without the need for immediate assembly, while at the same time, permitting the end-user or installer to install the doors on the cabinet readily and easily once the selected receiver means is placed in position. Thus, in cases where the receiver means has been installed, the remaining installation procedure merely involves snapping several components together, with a minimum or no tools being required, while storage of the cabinets and doors separately and neatly is clearly facilitated.

One embodiment of my invention permits one section of the hinge to be directly affixed to the door by means of screws or the like, while the other section may be readily attached to the frame by merely snapping it into a receiver plate mounted to the frame. Thus by affixing by screws the "door" section of the hinge directly to the door, it is possible to provide a selection of hinges to the consumer which selection offers a variety of distances between the pivot axis and the location of attachment to the door so that the size and style of the door may thus be varied. Since basic kitchen cabinetry seldom changes the present approach reduces the possibility that a particular type of cabinet will become obsolete. It should be noted that this particular convenience affords additional flexibility when the hinge section is secured to the door by receiver means as well.

Although the preferred embodiment of my hinge is in the form of a "knife" or "scissors"-type hinge, it is possible to practice my invention with a "pin"-type hinge. Knife type hinges, however, provide several advantages, the major of which is their ability to be concealed or recessed into a groove or slot provided in the door. Further, knife-type hinges are generally less costly to manufacture. In addition, by taking into consideration all possible design factors, it is readily possible to construct a hinge of the "knife" type such that the installation dimensions are relatively symmetrical at least with respect to the major plane of rotation passing through the interface between both sections, thereby eliminating the need for specific designs in the hinge to accommodate "right-hand" and "left-hand" doors. This arrangement is possible whether or not both hinge sections are affixed to the door and/or frame by receiver means.

In addition the hinge of my invention incorporates several unique features to maintain the door of a cabinet in the "closed-door" position. Also, to a certain degree, they provide a "self-closing" feature, particularly when the door is moved somewhat toward the closed position. To this end it will be seen that my hinge provides "hold-closed" and bias forces with respect to the "closed-door" position while utilizing a minimum amount of material and a limited amount of space, while providing such features at a minimum cost.

In one embodiment, for example, a spring plate device is positioned between the two pivotally connected sections of the hinge and arranged to cooperatively engage one section when the section is rotated with the door. The spring plate is maintained in fixed relation with the stationary section. A bump is provided on the stationary hinge section and a receiver aperture is provided in the spring plate for reception of the bump so as to prevent the spring plate from rotating with the rotatable hinge section. Other techniques for retention of the spring plate are also contemplated, such as, for example, the provision of end flanges on the spring plate to grip the stationary section of the hinge. By incorporation of such an intermediate plate of spring steel, it has been found that intermediate washers, such as nylon washers, need not be used to improve rotative action, since spring steel is harder and smoother than other steels and thus tends to minimize the friction which may otherwise be apparent between the sections of the hinge when one of them is rotated relative to the other.

In another embodiment of my inventive hinge, the section of the hinge which attaches to the door and rotates therewith, is configured and slotted in such a fashion as to engage a "bump" or correspondingly configured arcuate portion provided on the section which is secured to the frame. The functional result of this structural arrangement is that an attractive force is provided which draws the door toward the closed position at least when the door reaches a predetermined position relative to the cabinet, while a correspondingly shaped relief is provided to receive the "bump" and thereby retain the door in the "closed" position. In this embodiment it is also desirable to construct the rotative hinge section of spring steel which is ultimately appropriately tempered to provide spring properties.

By embedding a nylon (or other) roller with a spring behind the stationary section of the hinge and by appropriately shaping the appropriate portion of the other section, the other section will engage the roller when it is rotated. By reversing this arrangement and placing the "bump" on the stationary hinge at the front of the cabinet area, and the roller on the moving arm, a similar result may be achieved.

Because the receiver means of my invention may be provided for both the cabinet frame and the door (as well as for the cabinet alone), and the receiver means is preferably in the form of a receiver strap, the same receiver strap may be constructed to accommodate any type of hinge, including "knife" or "pin" types, or exposed or concealed types. Thus it is now possible for a manufacturer to deliver a cabinet by delivering cabinet frames separately from cabinet doors. Optionally, receiver straps may be provided on both cabinets an doors, thus reducing considerably the task of ultimate assembly. Even with receiver straps in position, doors and cabinet frames may be stored with a minimum of space.

Another feature of the present invention is that it may be utilized with any type of cabinet construction. For example, present day hinges are generally designed for a particular type of cabinet. One type of cabinet may have a flush frame front and another type may have a separate front frame (or stile). In the former arrangement, the front of the cabinet frame functions as the frame to which the hinges are affixed, and in the latter arrangement, a front frame, or "stile" is actually affixed to the cabinet and the hinges are attached to the stile. According to the present invention, a cabinet having no separate front stile can accept a full overlay door (i.e. the sum total of the door widths equal the width of the frame), in the same fashion that a cabinet having a front stile may be made to accept a full overlay door by merely selecting the appropriate hinge having the requisite dimension between the pivot axis of the hinge and the location of the receiver means. Alternately, with the hinge of the present invention, either type of cabinet may be made to accept a door or doors of lesser size, thereby selectively exposing portions of the frame front as "margins" which appear uniformly about the doors.

By constructing the receiver means of my invention in the form of a plate or strap which may receive a tab portion of a hinge section from either direction, and by constructing the hinge in a generally symmetrical fashion about the major plane of rotation extending between the sections, it will be appreciated that a given hinge may be used for attaching a right hand door or a left hand door to a cabinet or frame by merely reversing the orientation of the hinge.

In addition, by constructing the receiver in the form of a plate for attachment to a frame with forward guide tabs for engagement with the frame, the actual task of alignment of the receiver plate with either frame or front stile (as the case may be) is relatively simplified. Since no such guide tabs are required or necessary with the receiver plate which is securable to the door, the manufacturer may either provide separate types of receiver plates, or it may optionally provide receiver plates which include frangibly attached (and thus removable) guide tabs such that one type may readily be converted to the other type. Alternatively the guide tabs may be capable of penetrating the door material, thus obviating the need for removal thereof.

A preferred construction of my invention is embodied as a versatile self latching demountable knife-type hinge for pivotally mounting a cabinet door to a cabinet frame which comprises a first leaf section constructed of sheet steel and including a tab portion having a button-like member upstanding from one surface, a second leaf section constructed of sheet steel and attached to the first leaf section by pivot pin means for pivotal motion relative thereto, the second leaf section including a tab portion having a button-like member upstanding from one surface, a resilient member constructed of spring steel and positioned between the first and second leaf sections, the spring member defining at least one generally arcuate spring portion dimensioned, configured and positioned for interfering resilient engagement with a correspondingly configured and dimensioned portion of the second leaf section when the second leaf section is rotated relative to the first leaf section and to assist by resilient engagement, the movement of the second leaf section toward the closed-door position, and to bias the second leaf section in the closed door position. A first receiver strap is securable to the door and is configured for reception of the tab portion of the second leaf section, the receiver strap being constructed of spring sheet steel and having a raised generally central portion, the raised generally central portion defining an aperture for engaged resilient reception of the buttonlike member of the tab portion of the second leaf section to at least retain the second leaf section removably secured to the door. A second receiver strap is securable to the frame and is configured for reception of the tab portion of the first leaf section, the receiver strap being constructed of spring sheet steel having a raised generally central portion, the raised generally central portion being configured and defining an aperture for engaged resilient reception of the button-like member of the tab portion of the first leaf section to at least retain the first leaf section removably secured to the frame, such that the hinge is selectively removably securable to both the door and the frame.

BRIEF DESCRIPTION OF THE DRAWINGS

Preferred embodiments of the invention will be described herebelow with reference to the drawings wherein:

FIG. 7 is a bottom view, partially cut away and partially in cross section of the hinge of FIG. 6 mounted on a cabinet having its door in the open position;

FIG. 8 is a view taken along lines 8—8 of FIG. 7;

FIG. 9 is a view of still another embodiment of the hinge of my invention mounted on a cabinet having its door in the open position;

FIG. 10 is a view, partially in cross-section, taken along the lines 10—10 of FIG. 9;

FIG. 11 is a view, partially in cross-section, of the hinge of FIG. 10 in the "closed-door" position; and FIG. 12 is a view, partially in cross-section, of still another embodiment of the hinge of my invention.

BEST MODE FOR CARRYING OUT THE INVENTION

In the description which follows, and throughout the present specification, my inventive hinge is described particularly with respect to kitchen cabinets having doors which are mounted to frames in the form of front "stiles". However, it should be understood that my invention may also be utilized with doors of any type which are mountable to, and demountable from, any type of frame, including cabinet frames having no front stiles, permanently mounted doors for ingress into, and egress from, a building structure, or any other doors including such seasonally used doors such as screen doors which may be desirably selectively removed during off seasons.

Figure 1:
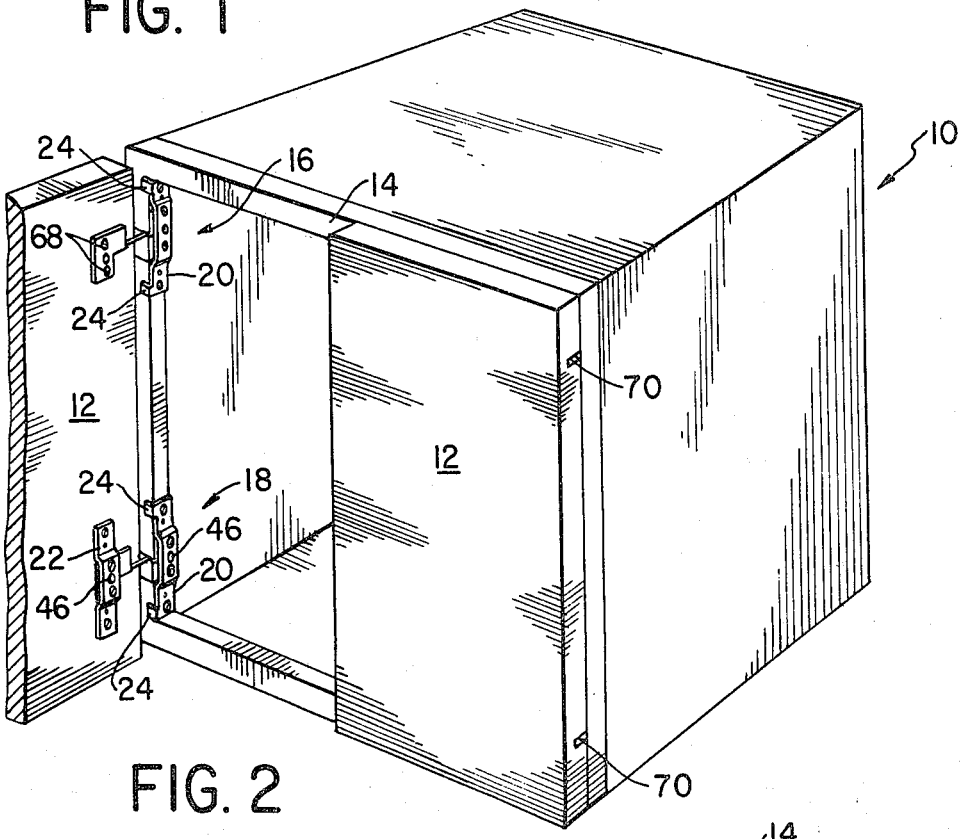
FIG. 1 is a perspective view of a cabinet utilizing my inventive hinge, and illustrating alternative arrangements for attachment of the hinge to the cabinet and to the door.

Referring to FIG. 1, there is illustrated a typical cabinet 10 having front doors 12, each mounted to forward frame (or "stile") 14 by two hinges 16 and 18, constructed according to my invention. In FIG. 1, the upper hinge shown mounting the left hand door, illustrates one embodiment of my invention wherein a single receiver strap is utilized to removably attach one hinge section to the frame, and wherein the other section of the hinge is attached to the door by conventional fasteners such as screws. The lower hinge 18 illustrated in FIG. 1 is identical in all respects to the upper hinge shown except that in this embodiment two receiver straps are utilized; one receiver strap to removably attach one section of the hinge to the frame, and a second receiver strap to removably attach the other section to the door.

Although both embodiments in FIG. 1 are interchangeable, the receiver strap associated with the frame of the cabinet preferably contains optional guide tabs 24 to fixedly locate its position with respect to the frames as shown. For use of receiver strap 20 on the door, the tabs 24 may be constructed to penetrate the door material, or they may be frangibly attached so that when they are removed, the receiver strap 20 is identical in all respects to the receiver strap 22 associated with hinge 18 and door 12. Also, although the lower hinge illustrated in FIG. 1 provides additional versatility in that the entire hinge is mountable and demountable selectively by use of receiver straps 22 and 24, the upper hinge provides substantial convenience to the assembler or installer in the respect that only one section of the hinge must be attached to the door by screws or the like, and the other section is conveniently quickly mountable and demountable with respect to the cabinet by merely removing the hinge from the receiver strap. As will become readily apparent from the detailed description which follows, the hinge of my invention eliminates the complexities previously encountered in marketing, storing, assembling and installing cabinets and associated doors. Specifically, my hinge provides substantial economy by minimizing the storage space requirements and available combinations of cabinets and doors of numerous styles, colors, and the like and makes it possible to provide the consumer with a wider selection of cabinet frames and doors at significantly reduced cost.

Referring once again to FIG. 1 in conjunction with FIGS. 2–4, hinge 18 will now be described. Hinge 18 includes first section 26 mounted to the cabinet frame 14 and second section 28 pivotably attached to the first section by rivet 30. First section 28 is attached to door 12 and is constructed of spring sheet steel appropriately tempered to provide spring properties and is configured to include an arcuate or rounded portion 32 configured and dimensioned to engage and disengage a correspondingly dimensioned "bump" 34 provided on second section 26 to bias the door toward the closed-door position at least after bump 32 passes over the center position in engagement with bump 34. When section 28 is rotated toward and away from the "closed-door" position, engagement between bumps 32 and 34 takes place and a relief cutout 36 permits spring portion 32 to resiliently move toward and away from bump 34. An arcuate cutout 38 is provided to positively engage bump 34 to act as a detent to retain section 28 in the "closed-door" position as shown in FIG. 4. Although first section 26 need not be constructed of spring steel, it may be desirably be so constructed. With spring steel material in both sections, the surfaces thereof are harder and smoother than other materials and thus provide smooth rotational interaction between the sections. In addition, spring steel provides excellent wear characteristics, particularly where this is desirable in the area of bump 34. Alternately it may be desirable to include a nylon washer (not shown) between the sections and positioned about the rivet 30 to facilitate smooth pivotal rotation of one section relative to the other.

Figure 2:
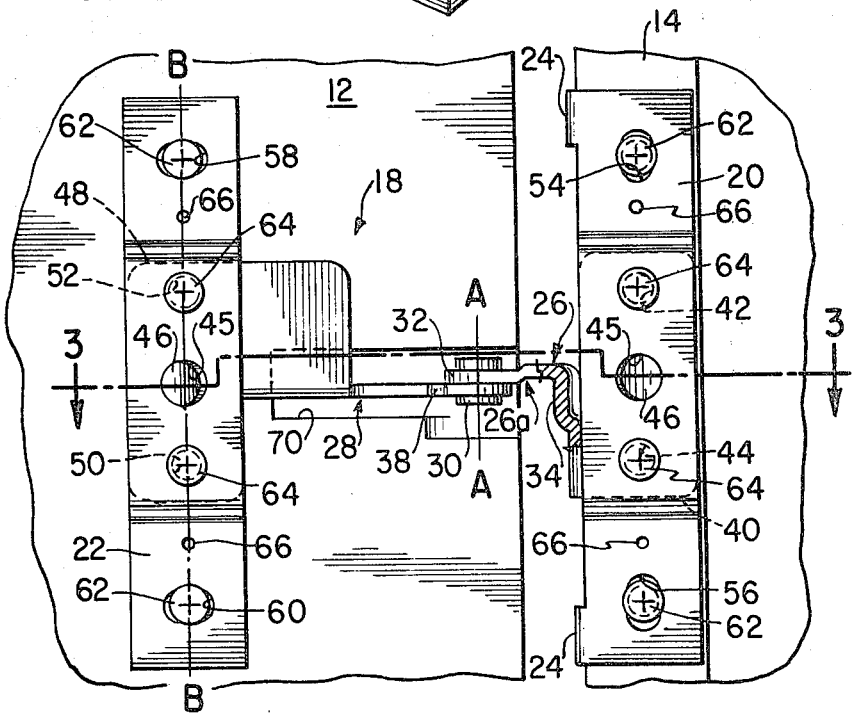
FIG. 2 is a view, partially in cross-section, of the hinge shown in FIG. 1.
Figure 3:
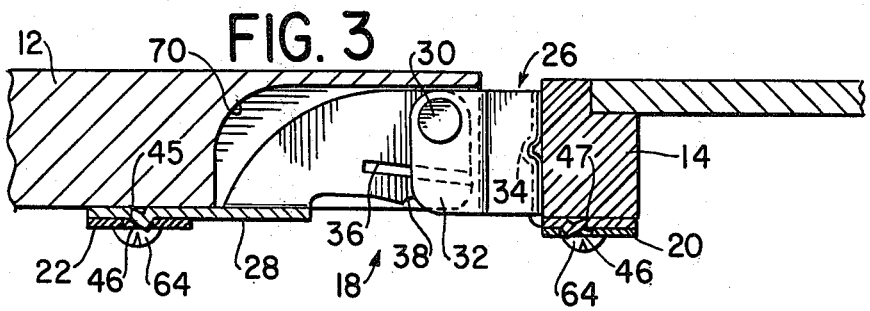
FIG. 3 is a view, partially in cross-section, taken along lines 3—3 of FIG. 2.
Figure 4:
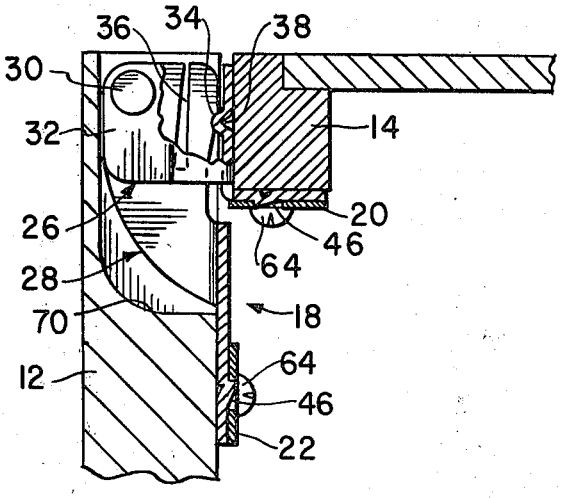
FIG. 4 is a view, partially in cross-section, of the hinge of FIG. 3 in the "closed-door" position;.
Figure 5:
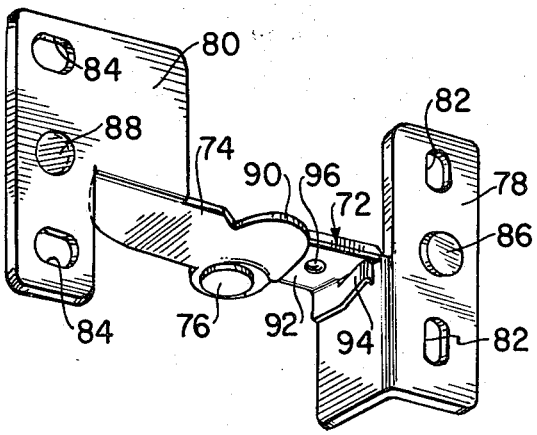
FIG. 5 is a perspective view from below, partially in cross-section, of another embodiment of the hinge of the present invention in the "open-door" position.

Referring now to FIG. 2, section 26 includes a tab portion 40 having apertures 42 and 44 spaced approximately equidistant from the major plane of rotation of the hinge (i.e. extending between the sections and medially between buttons 46 as they appear in FIG. 2) and a raised button-like portion 46 having a slanted upper surface as shown more clearly in FIG. 3. Similarly, section 28 includes a tab portion 48 having similarly spaced apertures 50 and 52. Each tab portion 40 and 48 is resiliently received and retained on the respective frame 14 and door 12 by resilient receiver straps 20 and 22 respectively, constructed of resilient spring sheet steel having appropriate apertures for reception of suitable screws. Particularly receiver strap 40 defines apertures 54 and 56 for reception of screws 62, the apertures being elongated in a vertical direction to facilitate vertical adjustments of the receiver strap and tab portion 40. Similarly, receiver strap 22 defines apertures 58 and 60 for reception of screws 62, the apertures being elongated in a horizontal direction to facilitate a further adjustments between the strap 22 and the door 12 relative to the frame 14. Receiver straps 20 and 22 are respectively secured to the frame 14 and door 12 by screws 62 and tab portions 40 and 48 are thus retained in position by the snapped engagement of buttons 46 with the receiver straps and by the reception of the buttons 46 within apertures 45 and 47 as shown in FIGS. 2 and 3. If desired, additional securement may be provided by screws 64 which further attach receiver straps 20 and 22 as well as tab portions 40 and 48 to their respective frame or door; however it should be emphasized that to practice the present invention, screws 64 are not necessary. Also, additional alignment or locater apertures 66 are provided in straps 20 and 22.

Referring to FIG. 2, apertures 42 and 44 are preferably equidistant from the major plane of rotation. In addition it is noted that by merely varying the distance (measured along a horizontal line in FIG. 2) between the pivotal axis of rotation A—A and the vertical axis B—B passing medially through apertures 50 and 52 (as well as through button 46 of tab 48) the type of cabinet door useable with a particular cabinet frame may be varied between a full overlay arrangement and an arrangement providing a marginal space of selected width about each door. This effect is the result of varying the location of the pivot axis relative to the door and the distance between axes A—A and B—B will determine the amount of margin which will appear around the doors.

One section 26 is preferably configured to have a portion 26*a* adjacent the pin 30 raised away from the other section to facilitate unobstructed rotation of one section relative to the other as is illustrated in FIG. 2.

This prevents undesired interference between surface portions of the first hinge section 26 and the second hinge section 28.

In practice, the cabinet 10 may be stored for sale with or without doors 12, and hinges 18 may either be installed on the doors, on the cabinet, or they may be packaged separately, with receiver straps 20 and 22 installed as shown, for attachment by the assembler or installer when the cabinet is delivered. The hinges are symmetrical and thus reversible and the same hinge may be used for right-hand or left-hand doors by merely reversing the orientation of its sections. When receiver strap 22 is not provided, the hinge 18 is identical to hinge 16 shown in FIG. 1 and tab portion 48 will be attached directly to the door by screws 68 as shown in FIG. 1.

Hinges 16 and 18 as shown are of the "knife" or "scissors" type whereby rivet 30 of each hinge and its surrounding hinge portions become hidden in a door notch or groove 70 as shown in FIG. 1. This hinge may be used with any type of cabinet—i.e. with or without a front stile—or with any types of doors—i.e. complete overlay of the front face of the cabinet, or margined or any combinations thereof.

FIGS. 5–8 illustrate another embodiment of my invention which includes first section 72 and second section 74 attached for relative pivotal rotation by rivet 76. Tab portions 78 and 80 are similar or identical to the corresponding tab portions 40 and 48 of the embodiment of FIGS. 2–4 and include identically spaced and configured apertures 82 and 84 as shown for the reception of screws, as well as respective buttons 86 and 88 for reception into correspondingly positioned and dimensioned apertures provided in receiver straps of the type shown in FIGS. 1–4.

Figure 6:
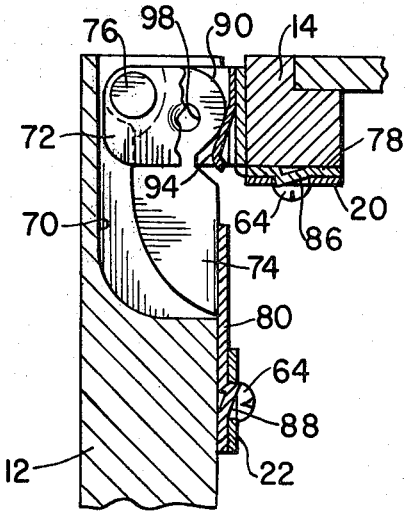
FIG. 6 is a view, partially cut away and partially in cross-section, of the hinge of FIG. 5 in the "closed-door" position.

Referring again to FIG. 5, section 74 includes a rounded protruding portion 90 dimensioned and configured for resilient engagement with a separate spring plate 92 having a correspondingly positioned arcuate spring portion 94 simultaneously appropriately raised and relieved for spring movements and to bias the hinge section 74 toward the "closed-door" position as shown particularly in FIG. 6. Spring plate 92 is retained between the sections 72 and 74 by rivet 76 as shown in FIG. 8 and it is preferably restrained from rotation with the sections by a raised portion 96 forming part of section 72 and received in aperture 98 of spring plate 92 as shown clearly in FIG. 8. It will be readily observed that the hinge of FIGS. 5–8 may be functionally selective by virtue of the fact that the distance from the button 88 to the pivot axis may be selective depending upon the style of door selected. As in the hinge of FIGS. 2–4, the hinge of FIGS. 5–8 is reversible and may be used for left hand or right doors and may be provided with one receiver strap such as hinge 16 of FIG. 1 or with two receiver straps as with hinge 18 of FIG. 1. Because of the provision of separate spring strap 92, neither of the hinge sections, 72 or 74, need be constructed of spring steel, and may be constructed of a relatively less expensive sheet steel. Thus a relatively inexpensive hinge is provided which is easily biased toward the "closed-door" position without the need for the relatively complex structures which are utilized in present day hinges.

Referring now to FIGS. 9–11 there is illustrated still another embodiment of the present invention. Hinge 100 is identical to the hinges previously described except that the hinge is constructed to bias the door toward the "closed-door" position by the fact that both sections 102 and 104 of the hinge are matingly constructed of spring steel and are structured to engage each other by the interaction of raised button 106 and a correspondingly configured recess 108 and curved progressively deepening groove 110 when one section is rotated relative to the other. As shown, the recess 108 and groove 110 are so configured to bias the hinge and door toward the "closed-door" position once it is rotated toward that position. Because it is necessary to provide a desirable amount of resistance to relative rotation, selectively dimensioned relief cutout grooves 112 may be provided to reduce the frictional engagement and interengagement between the hinge sections 102 and 104 as the door and one section 102 of the hinge is rotated. In addition since frictional and resistance forces in the hinge of FIG. 9 depend somewhat upon the type and weight of door which is mounted, depending upon circumstances and desired parameters, relief cutouts 112 may be selectively increased in length insitu to reduce the resistance to rotation of section 102. As shown in FIG. 9, a nylon (or other suitable material) washer 114 may optionally be provided to reduce any resistance to rotation of section 102 relative to section 104. Since sections 102 and 104 area preferably constructed of spring steel which is hardened and relatively smooth, it will be appreciated that the sections 102 and 104 of hinge 100 will encounter reduced resistance to rotation as a result of their material of construction.

Referring now to FIG. 12 still another hinge 115 is illustrated which is identical in all respects to the previously described hinges, but which provides a bias force toward the "closed door" position by alternate means. Hinge 115 has sections 116 and 118 which are constructed of sheet steel with separate spring 120 dimensioned, configured and retained in fixed relation to section 116 for engagement and disengagement with a corresponding bump 122 forming part of section 116. Spring 120 is configured to progressively engage and disengage bump 122 of section 116 when the door 12 is rotated toward and away from the cabinet, but this spring is also configured to bias and retain the door 12 toward the closed door position as shown in FIG. 12. In all other respects the hinge 114 of FIG. 12 is identical structurally and functionally to the hinges previously described except that in the hinge in FIG. 12, a separate spring mechanism is provided to retain the door in the closed position, a mechanism which is inexpensive, compact and extremely pleasing to the eye.

It will be readily appreciated that my invention is not limited to the embodiments as described, but may be practised effectively by selected combinations of features of each of these embodiments. Thus it should be understood that certain of the separate aspects and features of each of the embodiments described hereinabove with reference to the drawings may be combined effectively to construct a hinge which is contemplated by my invention and that the scope of my invention should be construed in accordance with the attached claims.

I claim:

1. A hinge for mounting a door or the like to a frame or the like, which comprises:

(a) first receiver means attachable to the frame, said first receiver means including guide means to position said receiver means with respect to the frame;

(b) a first hinge section defining a tab portion, said tab portion being configured for mating engaged reception by a portion of said receiver means to facilitate selective engaged attachment and/or detachment with respect to the frame;

(c) second receiver means attachable to the door;

(d) a second hinge section pivotally attached to said first hinge section, said second hinge section defining a tab portion configured for mating engaged reception by a portion of said second receiver means to facilitate selective engaged attachment and/or detachment with respect to the door;

(e) resilient spring means positioned for engagement with at least one of said first and second sections to retain the hinge in at least one of an open and closed door position, said resilient spring means being positioned to engage at least a portion of at least one of said hinge sections to retain the sections in at least one of open and closed door relative positions; and (f) at least one of said first and second sections defining a portion in an area adjacent the pivot axis raised away from adjacent portions of the other section to facilitate pivotal rotation of at least one section with respect to the other section to prevent interference of the sections.

2. The hinge according to claim 1 wherein said tab portion of said second section is generally rectangular and defines at least two apertures approximately equally spaced from the major plane of rotation of the hinge for reception of fastener members such as screws or the like to attach said tab portion to the door.

3. The hinge according to claim 1 wherein said tab portion of said second section is generally rectangular and includes means to facilitate engaged reception thereof within said receiver means secured to the door.

4. The hinge according to claim 3 wherein said receiver means securable to said frame is in the form of a strap device having a generally raised mid portion for reception of the tab portion of said first section, said strap device defining at least two apertures for reception of fastener members such as screws or the like to secure said strap to said frame.

5. The hinge according to claim 4 wherein said strap device defines at least one aperture positioned in the mid portion thereof.

6. The hinge according to claim 5 wherein said tab portion of said first section of said hinge defines a raised portion positioned for reception into said generally centrally located aperture of said receiver means for selective engaged attachment and/or detachment with respect to the frame.

7. The hinge according to claim 6 wherein said tab portion of said first section defines at least two apertures for reception of fastener means such as screws or the like, said apertures being generally elongated in a direction to facilitate adjustment of the location of said tab portion with respect to the frame.

8. The hinge according to claim 7 wherein said receiver means of said first section defines at least two apertures for reception of fastener members such as screws or the like, said apertures being generally elongated in a direction to provide selective adjustment of the position of said receiver means with respect to the frame.

9. The hinge according to claim 8 wherein said tab portion of said second section defines at least two apertures approximately equally spaced vertically from the major plane of rotation of the hinge extending through the interface between the sections, for reception of means such as screws or the like, said apertures being generally elongated to facilitate adjustment of the position of said tab section with respect to the door.

10. The hinge according to claim 9 wherein said resilient means is resilient spring material dimensioned, positioned and configured to be resiliently engaged by at least one of said first and second sections.

11. The hinge according to claim 10 wherein said resilient means is in the form of a resilient spring attached to at least one of said first and second sections and positioned to engage at least a portion of the other section and to retain the other section in at least one of a closed door and open door position.

12. The hinge according to claim 11 wherein said spring material is configured as a strap having a raised portion positioned, dimensioned and configured to progressively engage and disengage at least a portion of the other section when at least one of said hinge sections is pivotally rotated with respect to the other section.

13. The hinge according to claim 12 wherein said resilient means is in the form of a strap comprised of a spring material, said strap being positioned between said first and second sections and secured in position by said pivot pin and said resilient means further including a portion which is dimensioned and configured to progressively engage and disengage a correspondingly configured portion of one of said first and second sections when said section is pivotally rotated with respect to the other section.

14. The hinge according to claim 13 wherein at least one of said first and second sections is constructed of a resilient material and a portion thereof is configured to resiliently and progressively engage and disengage a correspondingly configured raised portion associated with the other section to resiliently retain the hinge in at least one of an open door and closed door position.

15. The hinge according to claim 14 wherein said second section is constructed of resilient spring material configured to progressively resiliently engage and disengage a correspondingly raised arcuate portion of said first section when said second section is pivotally rotated with respect to said first section.

16. The hinge according to claim 15 wherein said second section is constructed of spring steel tempered to provide cooperative resilient engagement and disengagement with said raised portion associated with said other section.

17. The hinge according to claim 16 wherein said second section defines a relief cutout portion to relieve the spring portion of said resilient material when the spring portion engages the raised portion associated with said first section.

18. The hinge according to claim 10 wherein said first and second sections are constructed of a resilient material and are configured and dimensioned to progressively resiliently engage and disengage each other to retain the hinge in at least one of an open door and closed door position.

19. The hinge according to claim 18 wherein one of said first and second sections defines a raised portion dimensioned, positioned, and configured to resiliently engage and disengage a correspondingly positioned recessed portion associated with the other section so as to retain the hinge in at least one of an open door and closed door position.

20. The hinge according to claim 19 wherein said pivot pin is in the form of a rivet which retains said first and second sections in pivotal attached relation.

21. The hinge according to claim 20 wherein at least one ring-like washer is positioned about said rivet and between said first and second sections to retain said first and second sections in pivotal rotational relation.

22. A self-latching hinge for pivotally mounting a cabinet door to a cabinet frame which comprises:

(a) a first hinge leaf section;

(b) a second hinge leaf section attached to said first hinge leaf section by a pivot pin for pivotal rotation relative thereto;

(c) receiver means in the form of a platelike member of resilient spring material securable by fastener means such as screws to the frame and defining an aperture;

(d) a tab portion secured to, or forming part of said first section for selective removable, snapped reception by said resilient receiver means so as to facilitate selective mounting and/or demounting of said first section with respect to the frame, said tab portion having a button-like member upstanding therefrom and being configured, positioned and dimensioned for resilient engaged reception by an aperture defined to said receiver means for retaining said tab portion and first section affixed to the frame;

(e) a tab portion connected to or forming part of said second section;

(f) means to removably attach and/or detach said second section with respect to the door; and (g) resilient means fixed with respect to said first section and positioned and dimensioned for progressive resilient engagement by said second section when said second section is pivotally rotated between positions corresponding to closed and open door positions, said resilient means and said second section being configured and dimensioned to cooperatively engage with each other at least to retain said second section and the door in the closed door position.

23. The hinge according to claim 22 wherein said resilient means is in the form of a strap constructed of spring steel, said strap being positioned and secured between said first and second sections and having a generally raised portion dimensioned and configured to engage a correspondingly configured raised portion of said second section for cooperative engagement therewith when said second section is pivotally rotated relative to said first section and at least for retaining said second section in a position corresponding to a closed door position.

24. The hinge according to claim 23 wherein said raised portion of said spring strap is arcuately configured and said correspondingly configured raised portion of said second section is arcuately configured such that when said second section is pivotally rotated relative to said first section the engagement between said arcuate portion of said second section and said arcuate portion of said spring strap is such as to bias said second section and the door toward the closed door position at least when the door approaches a predetermined location with respect to the closed-door position, and to retain said second section and the door in the closed door position.

25. The hinge according to claim 24 wherein said first and second sections are constructed of sheet spring steel and each of said tab portions defines a raised button-like portion for removable insertion and retention within a correspondingly configured receiver strap defining a generally central aperture for reception of the corresponding raised button like portion.

26. The hinge according to claim 25 wherein each of said tab portions define a pair of apertures positioned approximately equidistantly from the major pivotal plane of the hinge extending along the interface between said sections, said apertures being provided for reception of fastener means such as screws or the like to retain the tab portion to the corresponding frame or door.

27. The hinge according to claim 26 wherein said pair of equidistantly spaced apertures are elongated in predetermined directions to facilitate selective positioning of said first section with respect to the frame and said second section with respect to the door.

28. The hinge according to claim 27 further comprising a ring member positioned about said pivot pin and between said first and second sections to facilitate relatively smooth pivotal rotation of said second section relative to said first section.

29. The hinge according to claim 27 wherein said ring member is constructed of nylon.

30. The hinge according to claim 29 wherein said first section defines a portion adjacent said pivot pin which is raised upwardly from said second section to facilitate pivotal rotation of said first section with respect to said second section without interference therebetween.

31. A versatile self latching demountable knife-type hinge for pivotally mounting a cabinet door to a cabinet frame which comprises a first leaf section constructed of sheet steel and including a tab portion having a button-like member upstanding from one surface, a second leaf section constructed of sheet steel and attached to said first leaf section by pivot pin means for pivotal motion relative thereto, said second leaf section including a tab portion having a button-like member upstanding from one surface, a resilient member constructed of spring steel and positioned between said first and second leaf sections, said spring member defining at least one generally arcuate spring portion dimensioned, configured and positioned for interfering resilient engagement with a correspondingly configured and dimensioned portion of said second leaf section when said second leaf section is rotated relative to said first leaf section and at least to assist by resilient engagement, the movement of said second leaf section toward the closed-door position, and to bias said second leaf section in the closed door position, a first receiver strap securable to the door and configured for reception of said tab portion of said second leaf section, said receiver strap being constructed of spring sheet steel and having a raised generally central portion, said generally central portion defining an aperture for engaged resilient reception of said button-like member of said tab portion of said second leaf section to at least retain said second leaf section removably secured to the door, a second receiver strap securable to the frame and configured for reception of said tab portion of said first leaf section, said receiver strap being constructed of spring sheet steel and having a raised generally central portion, said generally central portion defining an aperture for engaged resilient reception of said button-like member of said tab portion of said first leaf section to at least retain said first leaf section removably secured to the frame, such that said hinge is selectively removably securable to the door and the frame, at least one of said first and second leaf sections defining a portion in an area adjacent said pivot pin raised away from the other section to facilitate pivotal rotation of at least one section with respect to the other section to prevent interference of the sections.

* * * * *